US011667985B2

(12) United States Patent
Han et al.

(10) Patent No.: US 11,667,985 B2
(45) **Date of Patent: *Jun. 6, 2023**

(54) COMPOSITION FOR FORMING INSULATION FILM OF ORIENTED ELECTRICAL STEEL SHEET, METHOD FOR FORMING INSULATION FILM BY USING SAME, AND ORIENTED ELECTRICAL STEEL SHEET HAVING INSULATION FILM FORMED THEREIN

(71) Applicant: POSCO, Pohang-si (KR)

(72) Inventors: Min Soo Han, Pohang-si (KR); Hyung Don Joo, Pohang-si (KR); Hyung Ki Park, Pohang-si (KR); Jae-Keun Shin, Pohang-si (KR); Chang-Soo Kim, Pohang-si (KR)

(73) Assignee: POSCO Co., Ltd, Pohang-si (KR)

( * ) Notice: Subject to any disclaimer, the term of this patent is extended or adjusted under 35 U.S.C. 154(b) by 1271 days.

This patent is subject to a terminal disclaimer.

(21) Appl. No.: 15/770,098

(22) PCT Filed: Dec. 22, 2015

(86) PCT No.: PCT/KR2015/014108

§ 371 (c)(1),
(2) Date: Apr. 20, 2018

(87) PCT Pub. No.: WO2017/069336

PCT Pub. Date: Apr. 27, 2017

(65) Prior Publication Data

US 2018/0312936 A1 Nov. 1, 2018

(30) Foreign Application Priority Data

Oct. 20, 2015 (KR) ..... 10-2015-0146105

(51) Int. Cl.
*C21D 8/12* (2006.01)
*C22C 38/00* (2006.01)
(Continued)

(52) U.S. Cl.
CPC ..... *C21D 8/1283* (2013.01); *C21D 1/30* (2013.01); *C21D 8/12* (2013.01); *C21D 8/1222* (2013.01);
(Continued)

(58) Field of Classification Search
None
See application file for complete search history.

(56) References Cited

FOREIGN PATENT DOCUMENTS

JP H03-39484 A 2/1991
JP H03-207868 A 9/1991
(Continued)

OTHER PUBLICATIONS

Wang et al., Determination of trace sodium, lithium, magnesium, and potassium impurities in colloidal silica by slurry introduction into an atmospheric-pressure solutioncathode glow discharge and atomic emission spectrometry, J. Anal. At. Spectrom., 2013, 28, pp. 234-240 (Year: 2013).*
(Continued)

*Primary Examiner* — Elizabeth Collister
(74) *Attorney, Agent, or Firm* — Morgan, Lewis & Bockius LLP

(57) ABSTRACT

The present invention relates to a composition for forming an insulation coating film of an oriented electrical steel sheet, including a first component (A) including a composite metal phosphate, a derivative thereof, or a mixture thereof, and a second component (B) including at least two colloidal silicas having different average particle diameters, a method for forming an insulation coating film using the same, and an oriented electrical steel sheet having an insulation coating film formed thereon.

12 Claims, 2 Drawing Sheets

(51) Int. Cl.

| | |
|---|---|
| ***C23C 22/22*** | (2006.01) |
| ***C22C 38/02*** | (2006.01) |
| ***C23C 22/74*** | (2006.01) |
| ***C21D 1/30*** | (2006.01) |
| ***C22C 38/04*** | (2006.01) |
| ***C22C 38/06*** | (2006.01) |
| ***C22C 38/18*** | (2006.01) |
| ***C22C 38/60*** | (2006.01) |

(52) U.S. Cl.

CPC ..... *C21D 8/1233* (2013.01); *C21D 8/1255* (2013.01); *C21D 8/1272* (2013.01); *C22C 38/00* (2013.01); *C22C 38/001* (2013.01); *C22C 38/002* (2013.01); *C22C 38/02* (2013.01); *C22C 38/04* (2013.01); *C22C 38/06* (2013.01); *C22C 38/18* (2013.01); *C22C 38/60* (2013.01); *C23C 22/22* (2013.01); *C23C 22/74* (2013.01)

(56) References Cited

FOREIGN PATENT DOCUMENTS

| | | | | |
|---|---|---|---|---|
| JP | H06-073555 | A | 3/1994 | |
| JP | H08-277475 | A | 10/1996 | |
| JP | H11-071683 | A | 3/1999 | |
| JP | 3071663 | B2 | 7/2000 | |
| JP | 2001-152354 | A | 6/2001 | |
| KR | 10-2006-0074664 | A | 7/2006 | |
| KR | 10-0733344 | B1 | 6/2007 | |
| KR | 100733344 | B1 * | 6/2007 | ..... C23C 22/07 |
| KR | 10-2013-0055911 | A | 5/2013 | |
| KR | 10-2013-0055912 | A | 5/2013 | |
| KR | 10-2014-0058249 | A | 5/2014 | |
| KR | 10-2014-0135833 | A | 11/2014 | |
| KR | 10-2015-0073851 | A | 7/2015 | |
| WO | 2015/099355 | A1 | 7/2015 | |

OTHER PUBLICATIONS

Machine translation Han et al. KR 10-2013-0055912 (via SEARCH) (Year: 2013).*

Machine translation Han et al. KR 100733344 B1 (via SEARCH) (Year: 2007).*

Extended European Search Report issued in European Application No. 15906787.5 dated Oct. 26, 2018.

Japanese Office Action dated May 21, 2019 issued in Japanese Patent Application No. 2018-520421.

International Search Report dated Jul. 25, 2016 issued in International Patent Application No. PCT/KR2015/014108 (with English translation).

* cited by examiner

COMPOSITION FOR FORMING INSULATION FILM OF ORIENTED ELECTRICAL STEEL SHEET, METHOD FOR FORMING INSULATION FILM BY USING SAME, AND ORIENTED ELECTRICAL STEEL SHEET HAVING INSULATION FILM FORMED THEREIN

RELATED APPLICATIONS

This application is the U.S. National Phase under 35 U.S.C. § 371 of International Application No. PCT/KR2015/014108, filed on Dec. 22, 2015 which in turn claims the benefit of Korean Patent Application No. 10-2015-0146105 filed on Oct. 20, 2015, the disclosures of which applications are incorporated by reference herein.

TECHNICAL FIELD

The present invention relates to a composition for forming an insulation coating film of an oriented electrical steel sheet, a method for forming an insulation coating film using the same, and an oriented electrical steel sheet having an insulation coating film formed thereon.

BACKGROUND ART

An oriented electrical steel sheet is generally an electrical steel sheet having a Si content of 3.1 wt %, and has a crystal texture in which an orientation of a crystal grain is aligned in a (110)[001] direction, thereby exhibiting excellent magnetic property in a rolling direction.

The magnetic property is known to be further improved when an core loss of the oriented electrical steel sheet is reduced to improve an insulation property. In this regard, as one of methods for reducing the core loss of the oriented electrical steel sheet, a method for forming a high tension insulation coating film on a surface has been actively studied.

Meanwhile, in order to commercialize the oriented electric steel sheet, an insulation coating film is formed on a surface, then subjected to processing into a proper shape, and stress relief annealing (SRA) is generally performed to remove stress caused by the processing. However, tension of the insulation coating film is reduced again due to high temperature in the SRA process, and thus a problem that core loss increases, and an insulation property decreases occurs in succession.

DISCLOSURE

Technical Problem

The present invention has been made in an effort to provide a composition for forming an insulation coating film of an oriented electrical steel sheet, a method for forming an insulation coating film using the same, and an oriented electrical steel sheet having an insulation coating film formed thereon having advantages of solving the above-described problem, that is, a problem caused by reduction in tension of the insulation coating film after stress relief annealing (SRA).

Technical Solution

An exemplary embodiment of the present invention provides a composition for forming an insulation coating film of an oriented electrical steel sheet including: a first component (A) including a composite metal phosphate, a derivative thereof, or a mixture thereof, and a second component (B) including at least two colloidal silicas having different average particle diameters, wherein the second component has an amount of 50 to 250 parts by weight based on 100 parts by weight of the first component (A).

According to an embodiment of the present invention, a weight ratio of the second component to the first component (A) (second component/first component) may be 1.3 to 1.8.

According to an embodiment of the present invention, the second component (B) may include a first colloidal silica having an average particle diameter of 12 nm, and a second colloidal silica having an average particle diameter of 5 nm.

More specifically, according to an embodiment of the present invention, a weight ratio of the second colloidal silica to the first colloidal silica may be 1:9 to 9:1.

According to an embodiment of the present invention, the second component (B) may have a total solid content of 20 wt % or more to 30 wt % or less According to an embodiment of the present invention, the second component (B) may include a sodium content inevitably included as impurities of less than 0.60 wt % (provided that except for 0 wt %).

Meanwhile, according to an embodiment of the present invention, the first component (A) may include one kind of composite metal phosphate selected from magnesium phosphate ($Mg(H_2PO_4)_2$) and aluminum phosphate ($Al(H_2PO_4)_3$), a derivative thereof, or a mixture thereof.

Specifically, according to an embodiment of the present invention, the composite metal phosphate may be a mixture of the magnesium phosphate ($Mg(H_2PO_4)_2$) and the aluminum phosphate ($Al(H_2PO_4)_3$), and a content of the aluminum phosphate ($Al(H_2PO_4)_3$) may be less than 70 wt % (provided that except for 0 wt %).

According to an embodiment of the present invention, the composite metal phosphate may have a total sod content of more than 58 wt % to less than 63 wt %.

According to an embodiment of the present invention, a derivative of the composite metal phosphate may be represented by the following Chemical Formula 1 or 2:

[Chemical Formula 1]

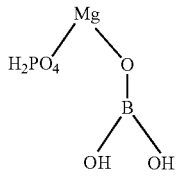

[Chemical formula 2]

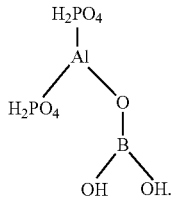

According to an embodiment of the present invention, the composition for forming the insulation coating film ay further include chromium oxide, solid silica, or a mixture thereof.

Another embodiment of the present invention provides a method for forming an insulation coating film of an oriented electrical steel sheet, the method including applying a composition for forming an insulation coating film on one side or both sides of an oriented electrical steel sheet; and drying the applied composition for forming the insulation coating film to form an insulation coating film, wherein the composition for forming an insulation coating film includes a first component (A) including a composite metal phosphate, a derivative thereof, or a mixture thereof, and a second component (B) including at least two colloidal silicas having different average particle diameters, and the second component has an amount of 50 to 250 parts by weight based on 100 parts by weight of the first component (A).

Specifically, according to an embodiment of the present invention, in the applying of the composition for forming the insulation coating film on one side or both sides of the oriented electrical steel sheet, the composition for forming the insulation coating film may be applied at 0.5 to 6.0 g/$m^2$ per one side ($m^2$) of the oriented electrical steel sheet.

Then, according to an embodiment of the present invention, the drying of the applied composition for forming the insulation coating film to form the insulation coating film may be performed at a temperature range of 550 to 900° C. for 10 to 50 seconds.

According to an embodiment of the present invention, the method may further include, before the applying of the composition for forming the insulation coating film on one side or both sides of the oriented electrical steel sheet, manufacturing the oriented electrical steel sheet, wherein the manufacturing of the oriented electrical steel sheet includes preparing a steel slab; hot-rolling the steel slab to manufacture a hot-rolled sheet; cold-rolling the hot-rolled sheet to manufacture a cold-roiled sheet; decarburizing and annealing the cold-rolled sheet; and applying an annealing separator to a surface of the decarburized and annealed steel sheet, followed by finish annealing, to obtain an oriented electrical steel sheet including a primary coating film, the steel slab has a composition containing 2.7 to 4.2 wt % of silicon (Si) and 0.02 to 0.06 wt % of antimony (Sb), including 0.02 to 0.08 wt % of tin (Sn), 0.01 to 0.30 wt % of chromium (Cr), 0.02 to 0.04 wt % of acid soluble aluminum (Al), 0.05 to 0.20 wt % of manganese (Mn), 0.04 to 0.07 wt % of carbon (C), 0.001 to 0.005 wt % of sulfur (S), and including 10 to 50 ppm of nitrogen (N), and Fe and other inevitable impurities as the remainder.

Yet another embodiment of the present invention provides an oriented electrical steel sheet having an insulation coating film formed thereon, including an oriented electrical steel sheet, and an insulation coating film disposed on one surface or both surfaces of the oriented electrical steel sheet, wherein the insulation coating film includes a first component (A) including a composite metal phosphate, a derivative thereof, or a mixture thereof, and a second component (B) including at least two colloidal silicas having different average particle diameters, and the second component has an amount of 50 to 250 parts by weight based on 100 parts by weight of the first component (A).

Specifically, according to an embodiment of the present invention, in the oriented electrical steel sheet having the insulation coating film formed thereon, $Ps/P_b$ may be 3.0 or less (provided that except for 0) at the time of stress relief annealing (SRA) at 800° C., $Ps/P_b$ may be 6.0 or less (provided that except for 0) at the time of stress relief annealing (SRA) at 840° C., and $Ps/P_b$ may be 8.0 or less (provided that except for 0) at the time of stress relief annealing (SRA) at 880° C.

(provided that $Ps/P_b$ is a result value obtained by measuring a crystallinity of the insulation coating film by synchrotron X-ray after the stress relief annealing at each temperature above, and means a ratio of a silica crystallization peak Ps to a baseline peak $P_b$).

According to an embodiment of the present invention, the oriented electrical steel sheet may include an oriented electrical steel sheet containing 2.7 to 4.2 wt % of silicon (Si) and 0.02 to 0.06 wt % of antimony (Sb), including 0.02 to 0.08 wt % of tin (Sn), 0.01 to 0.30 wt % of chromium (Cr), 0.02 to 0.04 wt % of acid soluble aluminum (Al), 0.05 to 0.20 wt % of manganese (Mn), 0.04 to 0.07 wt % of carbon (C), 0.001 to 0.005 wt % of sulfur (S), and including 10 to 50 ppm of nitrogen (N), and Fe and other inevitable impurities as the remainder, and a primary coating film.

Advantageous Effects

According to exemplary embodiments of the present invention, excellent tension may be maintained even after the SRA at high temperature, thereby minimizing problems of increase in core loss and decrease in insulation property.

MODE FOR INVENTION

Exemplary Embodiments of the Present Invention

Figure 1:
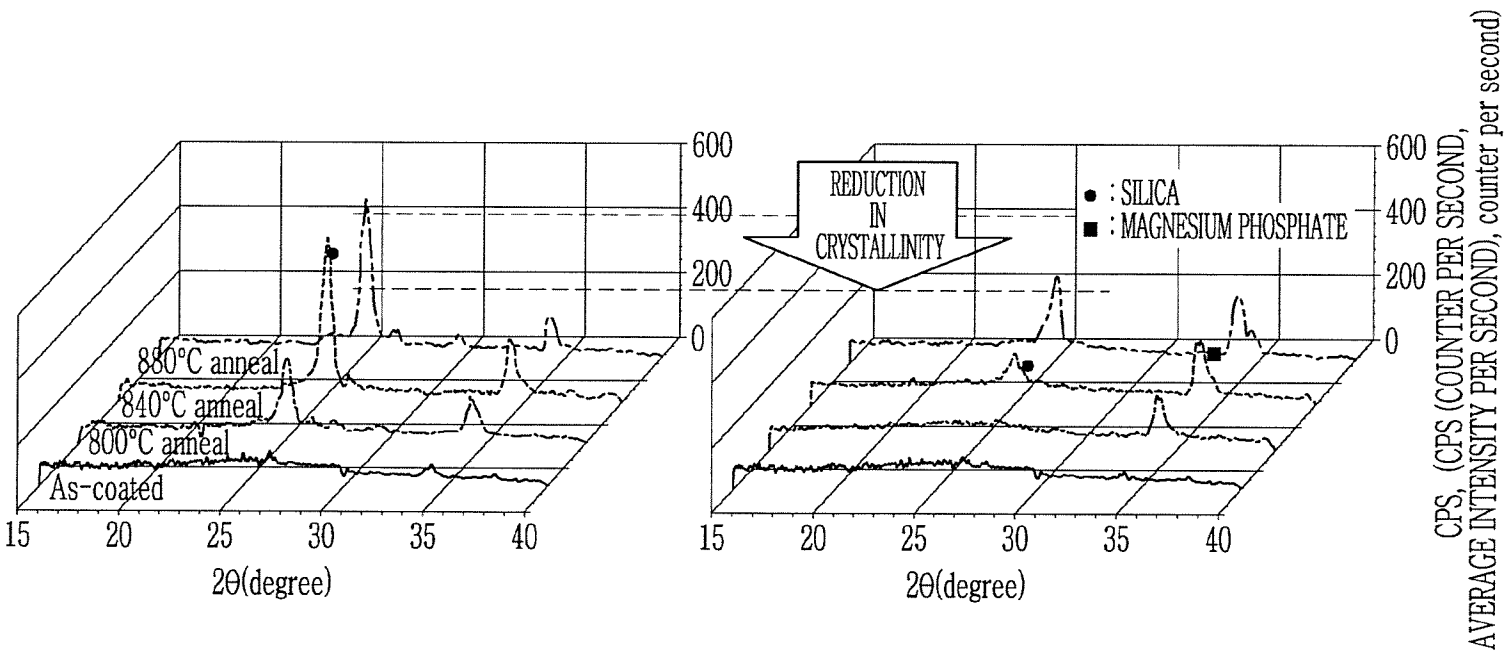
FIG. 1 is a graph showing degrees of crystallization of coating films measured by a synchrotron X-ray in Example 1 and Comparative Example 1 of the present invention before and after SRA treatment (SRA treatment at 800° C., 840° C. and 880° C., respectively).

In exemplary embodiments of the present invention, there are provided a composition for forming an insulation coating film of an oriented electrical steel sheet, a method for forming an insulation coating film using the same, and an oriented electrical steel sheet having an insulation coating film formed thereon, respectively.

An exemplary embodiment of the present invention provides a composition for forming an insulation coating film of an oriented electrical steel sheet including: a first component (A) including a composite metal phosphate, a derivative thereof, or a mixture thereof, and a second component (B) including at least two colloidal silicas having different average particle diameters, wherein the second component has an amount of 50 to 250 parts by weight based on 100 parts by weight of the first component (A).

Another embodiment of the present invention provides a method for forming an insulation coating film of an oriented electrical steel sheet, the method including applying a composition for forming an insulation coating film on one side or both sides of an oriented electrical steel sheet; and drying the applied composition for forming the insulation coating film to form an insulation coating film, wherein the composition for forming an insulation coating film includes a first component (A) including a composite metal phosphate, a derivative thereof, or a mixture thereof, and a second component (B) including at least two colloidal silicas having different average particle diameters, and the second component has an amount of 50 to 250 parts by weight based on 100 parts by weight of the first component (A).

Yet another embodiment of the present invention provides an oriented electrical steel sheet having an insulation coating film formed thereon, including an oriented electrical steel sheet, and an insulation coating film disposed on one surface or both surfaces of the oriented electrical steel sheet, wherein the insulation coating film includes a first component (A) including a composite metal phosphate, a derivative thereof, or a mixture thereof, and a second component (B) including at least two colloidal silicas having different average particle diameters, and the second component has an amount of 50 to 250 parts by weight based on 100 parts by weight of the first component (A).

A phosphate used in embodiments of the present invention is represented by Chemical Formula $M_x(H_2PO_4)_y$, and is defined as a composite metal phosphate in order to distinguish the phosphate from a metal phosphate represented by Chemical Formula $M_x(PO_4)_y$.

The "composite metal phosphate" may be prepared by using a reaction of phosphoric acid ($H_3PO_4$) with a metal hydroxide ($M_x(OH)_y$) or a metal oxide ($M_x(O)$. Specific examples thereof include cobalt phosphate ($Co(H_2PO_4)_2$), calcium phosphate ($Ca(H_2PO_4)_2$), zinc phosphate ($Zn(H_2PO_4)_2$), and the like, including aluminum phosphate ($Al(H_2PO_4)_3$) and magnesium phosphate ($Mg(H_2PO_4)_2$) used in the following Examples.

Hereinafter, embodiments of the present invention will be described in detail. However, the following exemplary embodiments are only provided as one embodiment of the present invention, and the present invention is not limited to the following Examples.

The composition for forming the insulation coating film of the oriented electrical steel sheet may 1) basically impart an adhesive force between the insulation coating film and the steel sheet by the first component, and 2) maintain excellent tension even after stress relief annealing (SRA) at high temperature by the second component, thereby minimizing problems of increase in core loss and decrease in insulation property.

Specifically, 1) the composite metal phosphate included as the first component is an inorganic material, and contributes to imparting the adhesive force between the insulation coating film and the steel sheet, and exhibiting excellent basic performances as the insulation coating film, such as corrosion resistance, insulation property, and close adhesion property, etc., even after the SRA.

Further, 2) the colloidal silica included as the second component functions to improve tension of the insulation coating film. Here, by using at least two kinds of colloidal silicas having different average particle diameters, a phenomenon that a silica component after high temperature stress relief annealing (SRA) is crystallized may be minimized as compared to a case where colloidal silicas each having the same average particle diameter are used.

Specifically, when the SRA is performed at a high temperature for a long time, it is known that crystallization of the colloidal silica component generally proceeds, and tension of the insulation coating film is rapidly lowered. When the tension of the insulation coating film is lowered as described above, the core loss may increase and magnetic property may increase, and thus marketability of the oriented electrical steel sheet may be deteriorated.

In order to solve this problem, at least two kinds of colloidal silicas having different average particle diameters are used in the second component. More specifically, the colloidal silicas having an average particle diameter smaller than that of generally used colloidal silica are used to solve the crystallization problem caused by the SRA. Meanwhile, when an extremely uniform network structure is formed using only the colloidal silica having the small average particle diameter, the crystallization caused by the SRA may be rather induced, and thus the colloidal silica having an average particle diameter that is generally used is appropriately compounded.

Further, colloidal silica that is generally used inevitably includes a sodium component ($Na^+$) in a manufacturing process thereof. The higher the content of the sodium component, the higher the reactivity of the colloidal silica, but a glass transition temperature tends to decrease, and thus performance of the insulation coating film after the SRA may be deteriorated. In consideration of this, the colloidal silica used as the second component may have a sodium content controlled to be lower than that of the generally used colloidal silica.

More specifically, the composition for forming the insulation coating film of the oriented electrical steel sheet is derived according to the following consideration process.

I. Consideration of Cause of Increase in Core Loss after Stress Relief Annealing (SRA)

In general, an oriented electric steel sheet is manufactured in a coil form after secondary coating (i.e., formation of an insulation coating film) that imparts coating film tension and insulation is performed. The thus manufactured coil is reprocessed and used in the form of a hoop having a suitable size according to use and size of a transformer when a final product is manufactured.

For example, in a wound core transformer used in a pole distribution transformer, a forming process in which an iron core cut in a hoop shape is processed by applying a slight stress is required, and in order to remove the stress applied to a material after the forming process, heat treatment at high temperature, that is, SRA, is performed.

Accordingly, the SRA may be regarded as a process for recovering the core loss that is damaged at the time of foaming. However, in conventional products, the core loss rather increases after the stress relief annealing, and when these products are manufactured into a transformer, no-load core loss of the transformer increases, which adversely affects performance of the transformer.

In this regard, a cause of the increase in core loss after the SRA was examined in view of a material itself (i.e., the oriented electrical steel sheet itself) and in view of a surface thereof, respectively.

First, in view of the material, two commercially available oriented electric steel sheet samples were prepared. Two types of stresses, specifically a permanent strain (Twin) and a temporary strain (Slip) were artificially applied, respectively, and then the SRA was performed for 2 hours at 850° C. under general conditions. As a result, the core loss increased in both samples. Accordingly, the increase in core loss after the SRA was determined to occur regardless of the kind of the material and the stress applied to the material.

Meanwhile, in order to examine influence of SRA performance temperature, time, and gas atmosphere in view of the surface, the SRA test was performed under conditions shown in Table 1 below and results thereof are also reported in Table 1 below. In addition, a graph showing a change in core loss according to the SRA treatment time and the temperature is shown in FIG. 2.

Figure 2:
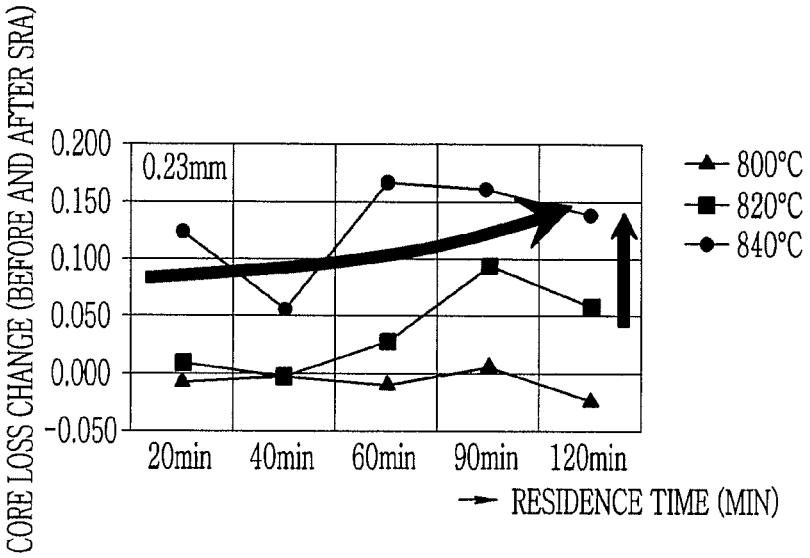
FIG. 2 is a graph showing changes in core loss according to SRA treatment time and temperature in a commercially available oriented electric steel sheet sample.

Specifically, it is confirmed that in Table 1 and FIG. 2, as the SRA performance temperature becomes higher, a degree of the increase in core loss is intensified, and the core loss increases rapidly at 875° C. Independently, it was confirmed that the increase in the core loss was good even though the SRA performance time was longer at 800° C., but as the SRA performance time at 820° C. or more was longer, the degree of the increase in core loss increased. In addition, it was confirmed that depending on gas atmosphere when performing the SRA, the degree of increase in the core loss increased when hydrogen gas was included.

TABLE 1

| Material characteristic | | SRA condition and core loss (W/kg) according to each condition | | |
|---|---|---|---|---|
| before SRA | | 820° C. | 840° C. | 875° C. |
| Thickness | Core loss (W/kg) | (4 vol % $H_2$ + 96 vol % $N_2$ _) | (4 vol % $H_2$ + 96 vol % $N_2$) | (4 vol % $H_2$ + 96 vol % $N_2$ _) |
| 0.23 mm | 0.83 | 0.84 | 0.85 | 0.87 |

From the above results, it may be determined that a more direct cause of the increase in core loss is occurrence of a defect on the surface rather than a defect in the material itself after the SRA.

II. Consideration of Cause of Surface Defect Occurrence after Stress Relief Annealing (SRA)

More specifically, in order to consider the cause of the surface defect after the SRA, consideration to the insulation coating film positioned on the outermost surface of the oriented electric steel sheet before the SRA needs to be preceded. Generally, when preparing the composition for forming the insulation coating film, various materials having desired functionality of the insulation coating film are blended.

First, in an embodiment of the present invention, colloidal silica was selected as one of major components, which serves to impart tension to the insulation coating film, and a condensation reaction by a chain reaction of silica is generated at 800° C. which is a general temperature for forming (i.e., drying) the insulation coating film.

This reaction may be represented by the following Chemical Reaction Scheme 1. Specifically, different silicas (i.e., A and B) may be subjected to continuous condensation reaction to prepare a silica condensation polymer (i.e., C).

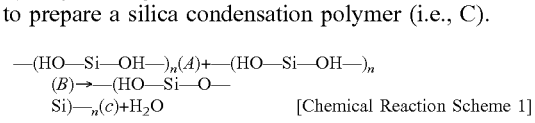

[Chemical Reaction Scheme 1]

Here, the silica condensation polymer (C) has a strong network structure, which is known to be thermally stable and low in thermal damage. However, it means that the stability is maintained up to a heat treatment temperature of a planarization annealing process, and it is difficult to maintain the stability at a high temperature of the SRA process (i.e., 850° C. as described above).

The reason for this is that the network structure of the silica condensation polymer (C) grows to a crystal at the high temperature of the SRA process. As described below, as shown in FIG. 1, when an insulation coating film is formed with a composition including colloidal silica, SRA is performed at 880° C., and a crystallinity of the coating film is measured by synchrotron X-ray, a ratio (Ps/Pb) of a silica crystallization peak (Ps) to a baseline peak (Pb) is 8.0 or more, and thus it is confirmed that the crystalinity is very high.

From the thus confirmed facts, it is considered that only when characteristics of the insulation coating film for the oriented electric steel sheet may be classified into characteristics immediately after the insulation coating film is formed and characteristics after the SRA has been completed, tension and insulation property should be excellent immediately after the insulation coating film is formed, and reduction in tension should be minimized after the SRA has been completed, it is possible to express excellent characteristics (for example, efficiency of the transformer, etc.,) when manufacturing a product.

From this determination, in an embodiment of the present invention, in order to minimize the reduction in tension after the SRA has been completed while forming the network structure of the silica condensation polymer (C) for the tension and the insulation property immediately after the formation of the insulation coating film, a method for preventing formation of an excessively uniform network structure is considered.

III. Consideration According to Particle Diameter and Sodium Content of Colloidal Silica Generally, it is known that as an average particle diameter of the colloidal silica is smaller, reactivity increases. Thus, in an embodiment of the present invention, colloidal silica having an average particle diameter smaller than that of the generally used colloidal silica is selected to improve the reactivity, thereby forming the network structure of the silica condensation polymer (C), and thus tension and the insulation property immediately after the insulation coating film is formed are improved.

Meanwhile, in order to minimize reduction in tension immediately after the SRA has been completed, colloidal silica having an average particle diameter that is generally used is appropriately compounded so as not to form an extremely uniform network structure, thereby controlling reactivity thereof and preventing formation of an excessively uniform network structure.

Meanwhile, the colloidal silica is manufactured by treating a sodium silicate solution with an ion-exchange resin and is inevitably known to include a trace amount of sodium component. In this regard, not only the (average) particle diameter but also the sodium component that is inevitably included as impurities may also be involved in the reactivity of the colloidal silica.

Specifically, the smaller the average particle diameter of the colloidal silica and the higher the content of the sodium component inevitably included as impurities, the greater the reactivity. However, as the content of the sodium component in the colloidal silica increases, a glass transition temperature tends to decrease and the glass transition temperature is generally lower than 900° C.

Therefore, in an embodiment of the present invention, a method for reducing an amount of sodium in the colloidal silica to increase the glass transition temperature, thereby improving thermal resistance is also considered.

IV. Embodiments of Present Invention Derived from a Series of Considerations

According to the above-described series of considerations, the embodiments of the present invention as described above are derived.

Specifically, the composition for forming the insulation coating film of the oriented electrical steel sheet may 1) basically impart an adhesive force between the insulation coating film and the steel sheet by the first component including the composite metal phosphate, and 2) improve tension and insulation property immediately after the insulation coating film is formed and maintain excellent tension even after the SRA at high temperature by the second component including at least two colloidal silicas having different average particle diameters, thereby minimizing problems of increase in core loss and decrease in insulation property.

Hereinafter, the composition for forming the insulation coating film of the oriented electrical steel sheet, the method for forming the insulation coating film using the same, and the oriented electrical steel sheet having the insulation coating film formed thereon are described in more detail.

Composition for Forming Insulation Coating Film of Oriented Electrical Steel Sheet First, as the first component (A), one kind of composite metal phosphate selected from magnesium phosphate ($Mg(H_2PO_4)_2$) and aluminum phosphate ($Al(H_2PO_4)_3$) may be used alone, or may also be used in combination.

In the latter case, the content of the aluminum phosphate ($Al(H_2PO_4)_3$) is limited so as not to be 70 wt % or more based on 100 wt % of the total amount of the first component (A). This is because, above the range, the aluminum component ($Al^+$) in the aluminum phosphate ($Al(H_2PO_4)_3$) increases the crystallization of the colloidal silica included in the second component.

Meanwhile, regardless in any case, a solid content is limited to 58 to 63 wt % based on 100 wt % of the total amount of the first component (A). This is because, it is concerned that when the solid content is 58 wt % or less, a free phosphoric acid ($H_3PO_4$) in the first component increases, and surface moisture absorption may increase when the insulation coating film is formed, and when the solid content is 63 wt % or more, excess solid content relative to pure phosphoric acid ($H_3PO_4$) may be precipitated.

As described above briefly, the composite metal phosphate included as the first component (A) may be prepared by using a reaction between a metal hydroxide ($M_x(OH)_y$) or a metal oxide ($M_xO$) and phosphoric acid ($H_3PO_4$).

For example, when a metal hydroxide ($M_x(OH)_y$) or a metal oxide ($M_xO$) is added, respectively, based on 100 parts by weight of an aqueous phosphoric acid solution including 85 wt % of free phosphoric acid ($H_3PO_4$), and reacted at 80° C. or more, respectively, each composite metal phosphate may be obtained.

Here, an added amount of the metal hydroxide ($M_x(OH)_y$) or the metal oxide ($M_xO$) is 1 to 40 parts by weight in the case of aluminum hydroxide ($Al(OH)_3$), 1 to 10 parts by weight in the case of cobalt hydroxide ($Co(OH)_2$), 1 to 15 parts by weight in the case of calcium oxide (CaO), 1 to 20 parts by weight in the case of zinc oxide (ZnO), and 1 to 10 parts by weight in the case of magnesium oxide (MgO), wherein each added amount is based on 100 parts by weight of the aqueous phosphoric acid solution.

Here, in order to improve close adhesion property of the insulation coating film by the composite metal phosphate, a boric acid may be added in a preparation process thereof, and the reaction may be maintained for 3 hours or longer, thereby inducing a condensation reaction of the composite metal phosphate and the boric acid. That is, the above-described "derivative of the composite metal phosphate" means a product of the condensation reaction of the composite metal phosphate and the boric acid.

Meanwhile, an added amount of the boric acid is limited to 5 to 7 parts by weight based on 100 parts by weight of the composite metal phosphate. This is because, when the added amount is low as 3 parts by weight or less, a degree of contribution to improvement of adhesion property is small, and when the added amount is high as 7 parts by weight or more, a surface of the insulation coating film is rough since the boric acid is precipitated.

Specifically, the derivative of the composite metal phosphate may be represented by the following Chemical Formula 1 or 2:

[Chemical Formula 1]

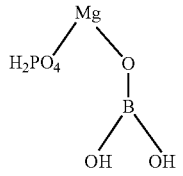

[Chemical Formula 2]

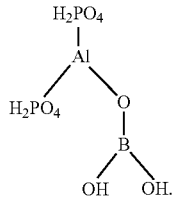

Meanwhile, colloidal silica included as the second component having a solid content of 30 wt % and an average particle diameter of 12 nm (first colloidal silica) may be mixed together with colloidal silica included as the second component having a solid content of 20 wt % and an average particle diameter of 5 nm (second colloidal silica) and used.

This is to improve properties immediately after the insulation coating film is formed by using the second colloidal silica having a small average particle diameter, and at the same time, to prevent excessive crystallization after the SRA by compounding the first colloidal silica of which an average particle diameter is a general size, by reviewing the above-described consideration.

Here, the first colloidal silica and the second colloidal silica may be compounded so that a weight ratio of the second colloidal silica to the first colloidal silica is 1:9 to 9:1, and specifically, 1:3 to 3:1. This is because it is concerned that when a content of the first colloidal silica in the second component is 10 wt % or less, crystallinity after the SRA may increase, and when the content of the first colloidal silica is 90 wt % or more, the reactivity is lowered and thus the tension immediately after the insulation coating film is formed is lowered.

Further, the second component may be composed to have an amount of 50 to 250 parts by weight based on 100 parts by weight of the first component (A). This is because, when the amount is 50 parts by weight or less, it is difficult to be expected to have an effect of increasing tension of the insulation coating film, and when the amount is 250 parts by weight or more, the amount of the first component is relatively low, and thus close adhesion property of the insulation coating film may be deteriorated.

More specifically, the weight ratio of the second component to the first component (A) (second component/first component) may be 1.3 to 1.8, and critical significance of the above-described range may be supported by comparing Examples and Comparative Examples to be described below.

Meanwhile, the composition for forming the insulation coating film may further include chromium oxide, solid silica, or a mixture thereof, for a purpose of reinforcing functionality.

Specifically, the chromium oxide may be used in an amount of 5 to 15 parts by weight, and the solid silica may be used in an amount of 5 to 15 parts by weight based on 100 parts by weight of the first component (A).

Method for Forming Insulation Coating Film of Oriented Electrical Steel Sheet

A composition for forming an insulation coating film may be used and applied on one side or both sides of an oriented electrical steel sheet so that an applied amount per one side is 0.5 to 6.0 g/m$^2$, and dried by heat-treatment in a temperature range of 550 to 900° C. for 10 to 50 seconds, thereby forming an insulation coating film.

Here, this is because, when the temperature is controlled to be 20±5° C. at the time of applying the oriented electric steel sheet composition, the applied amount per one side may be implemented as 4.0 to 5.0 g/m$^2$, and when the temperature is 20° C. or less, it is difficult to implement a predetermined applied amount since viscosity increases, and when the temperature is 20° C. or more, gelation of the colloidal silica in the composition accelerates, and surface quality of the insulation coating film may be deteriorated.

Meanwhile, the oriented electrical steel sheet has a primary coating film as finish annealing is achieved, and may include an oriented electrical steel sheet containing 2.7 to 4.2 wt % of silicon (Si) and 0.02 to 0.06 wt % of antimony (Sb), including 0.02 to 0.08 wt % of tin (Sn), 0.01 to 0.30 wt % of chromium (Cr), 0.02 to 0.04 wt % of acid soluble aluminum (Al), 0.05 to 0.20 wt % of manganese (Mn), 0.04 to 0.07 wt % of carbon (C), 0.001 to 0.005 wt % of sulfur (S), and including 10 to 50 ppm of nitrogen (N), and Fe and other inevitable impurities as the remainder, and a primary coating film.

Oriented Electrical Steel Sheet Having Insulation Coating Film Formed Thereon

According to the above-described method, in the oriented electrical steel sheet having the insulation coating film formed thereon, Ps/Pb may be 3.0 or less, specifically 2.5 or less (provided that except for 0) at the time of stress relief annealing (SRA) at 800° C., Ps/Pb may be 6.0 or less, specifically 5.4 or less (provided that except for 0) at the time of stress relief annealing (SRA) at 840° C., and Ps/Pb may be 8.0 or less, specifically 7.1 or less (provided that except for 0) at the time of stress relief annealing (SRA) at 880° C.

Here, the Ps/Pb is a result value obtained by measuring a crystallinity of the insulation coating film by synchrotron X-ray after the stress relief annealing at each of the above temperatures, and means a ratio of a silica crystallization peak Ps to a baseline peak Pb.

More specifically, when measuring the crystallinity of the insulation coating film, beam power may be limited to Co Ka (6.93 keV), a grinding incidence may be limited to 1 degree, and a step may be limited to 0.02 degree, the baseline peak (Pb) may be determined by an average intensity or an average intensity per second (counter per second) at 14 to 22 degrees, and the crystallization peak (Ps) of the silica may be determined by an average intensity or an average intensity per second (counter per second) at 24.5 to 26 degrees.

The Ps/$P_b$ value at the SRA at each temperature is supported by Examples to be described below.

Hereinafter, preferred Examples of the present invention, Comparative Examples compared to the Examples, and Evaluation Examples thereof are described. However, the following Examples are merely preferred exemplary embodiment of the present invention, and the present invention is not limited to the following Examples.

Specifically, (1) an oriented electric steel sheet (300*60 mm) having the same physical properties was used as a blank sample, (2) a composition for forming different insulation coating films was prepared, (3) each insulation coating film was formed, and (4) characteristics before and after the SRA were compared and evaluated, thereby determining Examples and Comparative Examples.

(1) Selection of Oriented Electrical Steel Sheet

An oriented electrical steel sheet (300*60 mm) including 0.055 wt % of C, 3.1 wt % of Si, 0.033 wt % of P, 0.004 wt % of S, 0.1 wt % of Mn, 0.029 wt % of Al, 0.0048 wt % of N, 0.03 wt % of Sb, 0.0005 wt % of Mg, and Fe and other inevitable impurities added as the remainder, having a thickness of 0.23 mm, and including a primary coating film formed by finish annealing, was selected as a blank sample.

(2) Preparation of Composition for Forming Insulation Coating Film

Composite metal phosphate: As described above, for a composite metal phosphate used in the present Example, aluminum phosphate and magnesium phosphate were prepared, respectively, by reacting metal oxide and orthophosphoric acid ($H_3PO_4$).

Here, a solid content of each composite metal phosphate (based on 100 wt %) was 62.5 wt %.

The composite metal phosphate in which a weight ratio of the aluminum phosphate and the magnesium phosphate is 5:5 was used in common for all the samples. Here, Colloidal silica; The following colloidal silicas A to C that were different from each other were selected.

X: colloidal silica in which an average particle diameter was 5 nm, and a solid content was 20 wt % and a sodium content was 0.45 wt % based on 100 wt % of the total amount of X colloidal silica.

Y: colloidal silica in which an average particle diameter was 12 nm, and a solid content was 30 wt % and a sodium content was 0.29 wt % based on 100 wt % of the total amount of Y colloidal silica.

Z: colloidal silica in which an average particle diameter was 12 nm, and a solid content was 30 wt % and a sodium content was 0.60 wt % based on 100 wt % of the total amount of Z colloidal silica.

Preparation of each sample: The composite metal phosphate prepared above was selected, and colloidal silica, chromium oxide, and solid silica (average particle diameter of 500 to 1000 nm) were compounded to satisfy the composition of Table 2 below based on 100 parts by weight of the composite metal phosphate, thereby preparing each sample.

TABLE 2

| Sample No. | Composite metal phosphate (based on 100 parts by weight) | Colloidal silica X (parts by weight) | Colloidal silica Y (parts by weight) | Colloidal silica C (parts by weight) | Colloidal silica X/Y | Colloidal silica/ Composite metal phosphate | Chromium oxide (parts by weight) | Solid silica (parts by weight) |
|---|---|---|---|---|---|---|---|---|
| 1 | 100 | — | — | 129 | | 1.3 | 9 | 6 |
| 2 | 100 | 162 | 107 | — | 50/50 | 2.7 | 9 | 6 |
| 3 | 100 | 10 | 122 | — | 5/95 | 1.9 | 9 | 6 |
| 4 | 100 | 49 | 97 | — | 25/75 | 1.8 | 9 | 6 |
| 5 | 100 | 97 | 65 | — | 50/50 | 1.6 | 9 | 6 |
| 6 | 100 | 145 | 32 | — | 75/25 | 1.5 | 9 | 6 |
| 7 | 100 | 184 | 6 | — | 95/5 | 1.3 | 9 | 6 |
| 8 | 100 | 32 | 22 | — | 50/50 | 0.46 | 9 | 6 |

In Table 2 above, for objective performance evaluation against Sample 1, the solid content in the total composition was the same except for Samples 2 and 8. Meanwhile, in Samples 2 and 8, the content ratio of the composite metal phosphate and the colloidal silica was greatly different from that of other samples, and whether there was a change in physical properties distinguished from other samples was confirmed.

(3) Formation of Insulation Coating Film

Each of the above samples was applied at an applied amount of 4 g/m$^2$ per one side of the oriented electrical steel sheet, and dried at 850° C. for 30 seconds to form insulation coating films each having a thickness of 2 μm.

(4) Evaluation of comparison of characteristics before and after SRA

As shown in the following Table 3, the steel sheet having the insulation coating film formed thereon from each sample was subjected to stress relief annealing (SRA) at each different temperature of 800, 840, or 875° C. for 2 hours or more in 100 vol % of $N_2$, or in a mixed gas atmosphere containing 95 vol % of $N_2$ and 5 vol % of $H_2$.

With respect to each sample before and after the SRA, core loss, insulation property, and crystallinity were measured on the basis of the following criteria, and results thereof are also recorded in Table 3 below.

In addition, crystallinity of the coating films of Sample 4 and Sample 1 was measured by synchrotron X-ray before and after the SRA treatment (the SRA treatment at 800, 840 and 880° C., respectively), and shown in the graph of FIG. 1.

Core loss: A change in core loss of a sample having a length of 300 mm and a width of 60 mm and the sample after the SRA was measured at an applied magnetic field of 1.7 T and a frequency of 50 Hz using a veneer magnetometer.

Insulation property: A stored current value when a current of 0.5 V and 1.0 A passed through a Franklin tester under 300 PSI pressure was measured.

Crystallinity: Crystallinity was measured by using synchrotron X-ray, wherein beam power was fixed to Co Ka (6.93 keV), a grinding incidence was fixed to 1 degree, and a step was fixed to 0.02 degree. In addition, the baseline peak (Pb) was determined by an average intensity or an average intensity per second (counter per second) at 14 to 22 degrees, and the crystallization peak (Ps) was determined by an average intensity or an average intensity per second (counter per second) at 24.5 to 26 degrees.

TABLE 3

| Sample No. | Before SRA Core loss (W/Kg) | Before SRA Insulation (mA) | Before SRA Crystallinity (Ps/Pb) | After SRA (800□ * 2 hr* $N_2$ 100%) Core loss (W/Kg) | After SRA (800□ * 2 hr* $N_2$ 100%) Insulation (mA) | After SRA (800□ * 2 hr* $N_2$ 100%) Crystallinity (Ps/Pb) | After SRA (845□ * 2 hr* $N_2$ 100%) Core loss (W/Kg) | After SRA (845□ * 2 hr* $N_2$ 100%) Insulation (mA) | After SRA (845□ * 2 hr* $N_2$ 100%) Crystallinity (Ps/Pb) | After SRA (875□ * 2 hr* $N_2$ 90% + $H_2$ 10%) Core loss (W/Kg) | After SRA (875□ * 2 hr* $N_2$ 90% + $H_2$ 10%) Insulation (mA) | After SRA (875□ * 2 hr* $N_2$ 90% + $H_2$ 10%) Crystallinity (Ps/Pb) | Evaluation |
|---|---|---|---|---|---|---|---|---|---|---|---|---|---|
| 1 | 0.82 | 203 | 1.2 | 0.84 | 226 | 6.5 | 0.85 | 654 | 9.8 | 0.87 | 855 | 12.5 | Comparative Example1 |
| 2 | 0.82 | 186 | 1.1 | 0.83 | 205 | 5.3 | 0.84 | 622 | 8.5 | 0.86 | 715 | 10.3 | Comparative Example2 |
| 3 | 0.81 | 120 | 1.1 | 0.80 | 154 | 3.0 | 0.81 | 567 | 6.0 | 0.81 | 553 | 8.0 | Comparative Example3 |
| 4 | 0.80 | 52 | 1.1 | 0.78 | 83 | 2.8 | 0.79 | 234 | 5.4 | 0.80 | 350 | 7.1 | Example1 |
| 5 | 0.80 | 38 | 1.1 | 0.79 | 72 | 2.5 | 0.78 | 212 | 5.0 | 0.79 | 332 | 6.0 | Example2 |
| 6 | 0.79 | 23 | 1.2 | 0.76 | 53 | 1.4 | 0.77 | 150 | 2.0 | 0.78 | 308 | 3.0 | Example3 |
| 7 | 0.82 | 198 | 1.1 | 0.81 | 223 | 5.5 | 0.83 | 579 | 6.3 | 0.84 | 659 | 8.2 | Comparative Example1 |
| 8 | 0.82 | 225 | 1.5 | 0.83 | 279 | 3.2 | 0.85 | 605 | 4.8 | 0.86 | 728 | 5.5 | Comparative Example1 |

Evaluation According to the Average Particle Diameter of Colloidal Silica

First, according to Table 3 and the results of FIG. 1 unlike Sample 1 using only colloidal silica having the same average particle diameter, Samples 3 to 7 using colloidal silica having different average particle diameters exhibited excellent characteristics in view of core loss and insulation property before and after the SRA at each temperature. These characteristics are supported by the crystallinity of Table 3 above.

In Sample 1, as the SRA temperature was higher, the crystallinity value also increased, and in particular, at a high temperature of 880° C., the crystallinity increased up to 12.5. On the other hand, in Samples 3 to 7, the crystallinity after the SRA could be controlled to 8.0 or less, and could be suppressed to the maximum of 3.0.

Further, Sample 1 showed a tendency to increase core loss after the SRA compared to before the SRA, which is also related to the change in the insulation value. Generally, when the crystallinity at the time of the SRA increases, electrical conductivity increases, and the insulation property is lowered, which is disproved by Sample 1. However, Samples 3 to 7 could prevent deterioration of the insulation property after the SRA as much as
possible as a result of minimizing crystal growth of silica during the SRA.

Evaluation According to Sodium Content in Colloidal Silica

Meanwhile, when comparing Sample 1 with Samples 4 to 7 in view of core loss, it was confirmed that in Samples 4 to 7, an increase rate of core loss before and after the SRA was low, or was rather decreased.

This is because the colloidal silica used in Samples 4 to 7 had a low sodium component (Na+) content relative to Sample 1, and thus the reactivity was lowered slightly, but the glass transition temperature increased to improve thermal resistance.

Here, the lowering of the reactivity of the colloidal silica indicated that it was difficult to form a stable insulation coating film, and thus there was a concern that the core loss after the SRA might increase, but this concern could be overcome by appropriately controlling the average particle diameter of the colloidal silica.

In other words, in Samples 4 to 7, a reaction surface area increased by appropriately compounding colloidal silica having an average particle diameter of 12 nm that is generally used, and colloidal silica having an average particle diameter of 5 nm that is smaller than that.

As a result, the problem of lowering the reactivity according to the reduction in sodium component (Na+) content in the colloidal silica could be offset, and the tension could be rather improved compared to Sample 1.

This fact could be proven from the lowest core loss value of Samples 4 to 7 when comparing with the core loss measurement values before the SRA in Table 3 above.

Evaluation According to Compounding Ratio

Meanwhile, Samples 4 to 6 were manufactured so that the weight ratio of the colloidal silica/composite metal phosphate was in the range of 1.3 to 1.8. It was confirmed that Sample 7 did not satisfy this range, and had all the evaluation results worse than those of Samples 4 to 6. Accordingly, it is evaluated that the compounding ratio of the colloidal silica and the composite metal phosphate (colloidal silica/composite metal phosphate) needs to be appropriately controlled within the above-described range.

At the same time, the characteristics of Samples 2, 7, and 8 in which each mixing ratio was extremely controlled could be confirmed in order to derive the compounding ratio (X/Y) of the colloidal silicas having different average particle diameters to the optimum range.

Specifically, when the composition ratio of X/Y did not satisfy the range of 1/9 to 9/1, or when the weight ratio of the colloidal silica/composite metal phosphate did not satisfy the range of 0.5 to 2.7, the core loss or the insulation property was inferior.

While Examples of the present invention have been described with reference to the accompanying drawings, the present invention is not limited to the above-described Examples, but may be formed in various different forms. It will be understood by those skilled in the art that other specific forms may be made without departing from the technical idea or essential features of the present invention. Therefore, it is to be understood that exemplary embodiments described hereinabove are illustrative rather than being restrictive in all aspects.

The invention claimed is:

1. A composition for forming an insulation coating film of an oriented electrical steel sheet, comprising:

a composite metal phosphate, a derivative thereof, or a mixture thereof, and at least two colloidal silicas having different average particle diameters, wherein a weight ratio of the colloidal silicas to the composite metal phosphate, the derivative thereof, or the mixture thereof (colloidal silicas/composite metal phosphate, a derivative thereof, or a mixture thereof) is 1.3 to 1.8.

2. The composition of claim 1, wherein:

the at least two colloidal silicas include a first colloidal silica having an average particle diameter of 12 nm, and a second colloidal silica having an average particle diameter of 5 nm.

3. The composition of claim 2, wherein:

a weight ratio of the second colloidal silica to the first colloidal silica is 1:9 to 9:1.

4. The composition of claim 1, wherein:

the at least two colloidal silicas include a sodium content inevitably included as impurities of less than 0.60 wt % (provided that except for 0 wt %).

5. The composition of claim 1, wherein:

the composite metal phosphate, the derivative thereof, or the mixture thereof includes one kind of composite metal phosphate selected from magnesium phosphate ($Mg(H_2PO_4)_2$) and aluminum phosphate ($Al(H_2PO_4)_3$), a derivative thereof, or a mixture thereof.

6. The composition of claim 5, wherein:

the composite metal phosphate is a mixture of the magnesium phosphate ($Mg(H_2PO_4)_2$) and the aluminum phosphate ($Al(H_2PO_4)_3$), and a content of the aluminum phosphate ($Al(H_2PO_4)_3$) is less than 70 wt % (provided that except for 0 wt %) based on 100 wt % of the mixture.

7. The composition of claim 6, wherein:

the composite metal phosphate has a total solid content of more than 58 wt % to less than 63 wt %.

8. The composition of claim 5, wherein:

the derivative of the composite metal phosphate is represented by the following Chemical Formula 1 or 2:

[Chemical Formula 1]

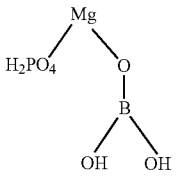

[Chemical Formula 2]

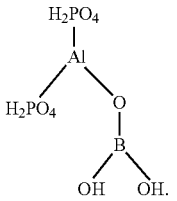

9. The composition of claim 1, further comprising:

chromium oxide, solid silica, or a mixture thereof.

10. An oriented electrical steel sheet having an insulation coating film formed thereon, comprising:

an oriented electrical steel sheet, and an insulation coating film disposed on one surface or both surfaces of the oriented electrical steel sheet, wherein the insulation coating film includes a composite metal phosphate, a derivative thereof, or a mixture thereof, and at least two colloidal silicas having different average particle diameters, wherein a weight ratio of the colloidal silicas to the composite metal phosphate, a derivative thereof, or a mixture thereof (colloidal silicas/composite metal phosphate, a derivative thereof, or a mixture thereof) is 1.3 to 1.8.

11. The oriented electrical steel sheet of claim 10, wherein:

in the oriented electrical steel sheet having the insulation coating film formed thereon, $Ps/P_b$ is 3.0 or less (provided that except for 0) at the time of stress relief annealing (SRA) at 800° C., provided that $Ps/P_b$ is a result value obtained by measuring a crystallinity of the insulation coating film by synchrotron X-ray after the stress relief annealing at each temperature above, and means a ratio of a silica crystallization peak Ps to a baseline peak $P_b$.

12. The oriented electrical steel sheet of claim 10, wherein:

in the oriented electrical steel sheet having the insulation coating film formed thereon, $Ps/P_b$ is 6.0 or less (provided that except for 0) at the time of stress relief annealing (SRA) at 840° C., provided that $Ps/P_b$ is a result value obtained by measuring a crystallinity of the insulation coating film by synchrotron X-ray after the stress relief annealing at the temperature above, and means a ratio of a silica crystallization peak Ps to a baseline peak $P_b$.

* * * * *